US008515082B2

(12) United States Patent
Breebaart

(10) Patent No.: US 8,515,082 B2
(45) Date of Patent: Aug. 20, 2013

(54) METHOD OF AND A DEVICE FOR GENERATING 3D SOUND

(75) Inventor: Jeroen Dirk Breebaart, Veldhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1392 days.

(21) Appl. No.: 12/066,506

(22) PCT Filed: Sep. 6, 2006

(86) PCT No.: PCT/IB2006/053126
§ 371 (c)(1),
(2), (4) Date: Mar. 12, 2008

(87) PCT Pub. No.: WO2007/031906
PCT Pub. Date: Mar. 22, 2007

(65) Prior Publication Data

US 2008/0304670 A1 Dec. 11, 2008

(30) Foreign Application Priority Data

Sep. 13, 2005 (EP) ..... 05108405

(51) Int. Cl.
*H04R 5/00* (2006.01)

(52) U.S. Cl.
USPC ..... 381/17; 381/300

(58) Field of Classification Search
USPC ..... 381/17, 300, 310
See application file for complete search history.

(56) References Cited

U.S. PATENT DOCUMENTS

| | | | |
|---|---|---|---|
| 6,243,476 B1 | 6/2001 | Gardner | |
| 2002/0055827 A1 | 5/2002 | Kyriakakis | |
| 2003/0026441 A1 | 2/2003 | Faller | |
| 2005/0058278 A1 * | 3/2005 | Gallego Hugas et al. | 379/406.01 |
| 2005/0058304 A1 | 3/2005 | Baumgarte et al. | |
| 2005/0180579 A1 | 8/2005 | Baumgarte et al. | |

FOREIGN PATENT DOCUMENTS

| | | | |
|---|---|---|---|
| EP | 0836365 | A2 | 4/1998 |
| EP | 1551205 | A1 | 7/2005 |
| JP | 2003009296 | A | 1/2003 |
| WO | 0162045 | A1 | 8/2001 |
| WO | WO2004097794 | A2 | 11/2004 |

OTHER PUBLICATIONS

Faller et al: "Efficient Representation of Spatial Audio Using Perceptual Parametrization"; Applications of Signal Processing to Audio and Acoustics, 2001 IEEE Workshop on Oct. 21-24, 2001, Piscataway, NJ, USA, IEEE Oct. 21, 2001, pp. 199-201.

Oomen et al: "MPEG4-EXT: CE on Low Complexity Parametric Stereo", International Standard ISO/IEC, MPEG2003/M10366, Dec. 2003, pp. 1-37.

(Continued)

*Primary Examiner* — Fernando L Toledo
*Assistant Examiner* — Neil Prasad

(57) ABSTRACT

A device for processing audio data includes a summation unit configured to receive a number of audio input signals for generating a summation signal, a filter unit configured to filter the summation signal dependent on filter coefficient resulting in at least two audio output signals. A parameter conversion unit is configured to receive position information, which is representative of spatial positions of sound sources of the audio input signals, and spectral power information which is representative of a spectral power of the audio input signals. The parameter conversion unit is configured to generate the filter coefficients based the position information and the spectral power information. The parameter conversion unit is further configured to receive transfer function parameters and generate the filter coefficients in dependence on the transfer function parameters.

14 Claims, 3 Drawing Sheets

(56) References Cited

OTHER PUBLICATIONS

Engdegard et al: "Synthetic Ambience in Parametric Stereo Coding"; Proceedings of the 116th Audio Engineering Society, May 8-11 in Berlin, Germany. 12 Page Document.

Georgiou et al: "A Multiple Input Single Output Model for Rendering Virtual Sound Sources in Real Time"; 2000 IEEE International Conference on Multimedia and Expo, pp. 253-256.

* cited by examiner

METHOD OF AND A DEVICE FOR GENERATING 3D SOUND

FIELD OF THE INVENTION

The invention relates to a device for processing audio data.

The invention also relates to a method of processing audio data.

The invention further relates to a program element.

Furthermore, the invention relates to a computer-readable medium.

BACKGROUND OF THE INVENTION

As the manipulation of sound in virtual space begins to attract people's attention, audio sound, especially 3D audio sound, becomes more and more important in providing an artificial sense of reality, for instance, in various game software and multimedia applications in combination with images. Among many effects that are heavily used in music, the sound field effect is thought of as an attempt to recreate the sound heard in a particular space.

In this context, 3D sound, often termed as spatial sound, is sound processed to give a listener the impression of a (virtual) sound source at a certain position within a three-dimensional environment.

An acoustic signal coming from a certain direction to a listener interacts with parts of the listener's body before this signal reaches the eardrums in both ears of the listener. As a result of such an interaction, the sound that reaches the eardrums is modified by reflections from the listener's shoulders, by interaction with the head, by the pinna response and by the resonances in the ear canal. One can say that the body has a filtering effect on the incoming sound. The specific filtering properties depend on the sound source position (relative to the head). Furthermore, because of the finite speed of sound in air, the significant inter-aural time delay can be noticed depending on the sound source position. Head-Related Transfer Functions (HRTFs), more recently termed the anatomical transfer function (ATF), are functions of azimuth and elevation of a sound source position that describe the filtering effect from a certain sound source direction to a listener's eardrums.

An HRTF database is constructed by measuring, with respect to the sound source, transfer functions from a large set of positions (typically at a fixed distance of 1 to 3 meters, and with a spacing of around 5 to 10 degrees in horizontal and vertical directions) to both ears. Such a database can be obtained for various acoustical conditions. For example, in an anechoic environment, the HRTFs capture only the direct transfer from a position to the eardrums, because no reflections are present. HRTFs can also be measured in echoic conditions. If reflections are captured as well, such an HRTF database is then room-specific.

HRTF databases are often used to position 'virtual' sound sources. By convolving a sound signal by a pair of HRTFs and presenting the resulting sound over headphones, the listener can perceive the sound as coming from the direction corresponding to the HRTF pair, as opposed to perceiving the sound source 'in the head', which occurs when the unprocessed sounds are presented over headphones. In this respect, HRTF databases are a popular means for positioning virtual sound sources. Applications in which HRTF databases are used include games, teleconferencing equipment and virtual reality systems.

OBJECT AND SUMMARY OF THE INVENTION

It is an object of the invention to improve audio data processing for creating spatialized sound allowing virtualization of multiple sound sources in an efficient manner.

In order to achieve the object defined above, a device for processing audio data, a method of processing audio data, a program element and a computer-readable medium as defined in the independent claims are provided.

In accordance with an embodiment of the invention, a device for processing audio data is provided, wherein the device comprises a summation unit adapted to receive a number of audio input signals for generating a summation signal, a filter unit adapted to filter said summation signal dependent on filter coefficients resulting in at least two audio output signals, and a parameter conversion unit adapted to receive, on the one hand, position information, which is representative of spatial positions of sound sources of said audio input signals, and, on the other hand, spectral power information which is representative of a spectral power of said audio input signals, wherein the parameter conversion unit is adapted to generate said filter coefficients on the basis of the position information and the spectral power information, and wherein the parameter conversion unit is additionally adapted to receive transfer function parameters and generate said filter coefficients in dependence on said transfer function parameters.

Furthermore, in accordance with another embodiment of the invention, a method of processing audio data is provided, the method comprising the steps of receiving a number of audio input signals for generating a summation signal and filtering said summation signal dependent on filter coefficients resulting in at least two audio output signals, receiving, on the one hand, position information, which is representative of spatial positions of sound sources of said audio input signals, and, on the other hand, spectral power information which is representative of a spectral power of said audio input signals, generating said filter coefficients on the basis of the position information and the spectral power information, and receiving transfer function parameters and generating said filter coefficients in dependence on said transfer function parameters.

In accordance with another embodiment of the invention, a computer-readable medium is provided, in which a computer program for processing audio data is stored, which computer program, when being executed by a processor, is adapted to control or carry out the above-mentioned method steps.

Moreover, a program element for processing audio data is provided in accordance with yet another embodiment of the invention, which program element, when being executed by a processor, is adapted to control or carry out the above-mentioned method steps.

Processing audio data according to the invention can be realized by a computer program, i.e. by software, or by using one or more special electronic optimization circuits, i.e. in hardware, or in a hybrid form, i.e. by means of software components and hardware components.

Conventional HRTF databases are often quite large in terms of the amount of information. Each time-domain impulse response can comprise about 64 samples (for low-complexity, anechoic conditions) up to several thousands of samples long (in reverberant rooms). If an HRTF pair is measured at ten (10) degrees resolution in vertical and horizontal directions, the amount of coefficients to be stored amounts to at least 360/10*180/10*64=41472 coefficients (assuming 64-sample impulse responses) but can easily become an order of magnitude larger. A symmetrical head would require (180/10)*(180/10)*64 coefficients (which is half of 41472 coefficients).

The characterizing features according to the invention particularly have the advantage that virtualization of multiple virtual sound sources is enabled with a computational complexity that is almost independent of the number of virtual sound sources.

In other words, multiple simultaneous sound sources may be advantageously synthesized with a processing complexity that is roughly equal to that of a single sound source. With a reduced processing complexity, real-time processing is advantageously possible, even for a large number of sound sources.

A further object envisaged by the embodiments of the invention is to reproduce a sound pressure level at a listener's eardrums that is equivalent to the sound pressure that would be present if an actual sound source were placed in the location (3D position) of the virtual sound source.

In a further aspect, there is an aim to create rich auditory environments that can be used as user interfaces for both visually impaired and sighted people. The applications according to the invention are capable of rendering virtual acoustic sound sources giving a listener the impression that the sources are at their correct spatial location.

Further embodiments of the invention will be described hereinafter with reference to the dependent claims.

Embodiments of the device for processing audio data will now be described. These embodiments may also be applied for the method of processing audio data, for the computer-readable medium and for the program element.

In one aspect of the invention, if the audio input signals are already mixed, the relative level of each individual audio input signal can be adjusted to some extent on the basis of spectral power information. Such adjustments can only be done within limits (for example, a maximum change of 6 or 10 dB). Usually, the effect of distance is much greater than 10 dB, due to the fact that the signal level scales approximately linearly with the inverse of the sound source distance.

Advantageously, the device may additionally comprise a scaling unit adapted to scale the audio input signals based on gain factors. In this context, the parameter conversion unit may additionally be adapted advantageously to receive distance information representative of distances of sound sources of the audio input signals and to generate the gain factors based on said distance information. Thus, an effect of distance may be achieved in a simple and satisfying manner. The gain factor may decrease by one over the distance. The power of the sound sources may thereby be modeled or adapted in accordance with acoustical principles.

Optionally, as applicable in the case of large distances of the sound sources, the gain factors may reflect air absorption effects. Thus, a more realistic sound sensation may be achieved.

In accordance with an embodiment, the filter unit is based on Fast Fourier-Transform (Ft). This may allow efficient and quick processing.

HRTF databases may comprise a limited set of virtual sound source positions (typically at a fixed distance and 5 to 10 degrees of spatial resolution). In many situations, sound sources have to be generated for positions in between measurement positions (especially if a virtual sound source is moving across time). Such a generation requires interpolation of available impulse responses. If HRTF databases comprise responses for vertical and horizontal directions, an interpolation has to be performed for each output signal. Hence, a combination of 4 impulse responses for each headphone output signal is required for each sound source. The number of required impulse responses becomes even more important if more sound sources have to be "virtualized" simultaneously.

In an advantageous aspect of the invention, HRTF model parameters and parameters representing HRTFs may be interpolated in between the spatial resolutions that are stored. By providing HRTF model parameters according to the present invention over conventional HRTF tables, an advantageous faster processing can be performed.

A main field of application of the system according to the invention is processing audio data. However, the system can be embedded in a scenario in which, in addition to the audio data, additional data are processed, for instance, related to visual content. Thus, the invention can be realized in the flame of a video data-processing system.

The device according to the invention may be realized as one of the devices of the group consisting of a vehicle audio system, a portable audio player, a portable video player, a head-mounted display, a mobile phone, a DVD player, a CD player, a hard disk-based media player, an internet radio device, a public entertainment device and an MP3 player. Although the mentioned devices relate to the main fields of application of the invention, any other application is possible, for example, in telephone-conferencing and telepresence; audio displays for the visually impaired; distance learning systems and professional sound and picture editing for television and film as well as jet fighters (3D audio may help pilots) and pc-based audio players.

The aspects defined above and further aspects of the invention are apparent from the embodiments to be described hereinafter and will be explained with reference to these embodiments.

BRIEF DESCRIPTION OF THE DRAWINGS

The invention will be described in more detail hereinafter with reference to examples of embodiments, to which the invention is not limited.

DESCRIPTION OF EMBODIMENTS

Figure 1:
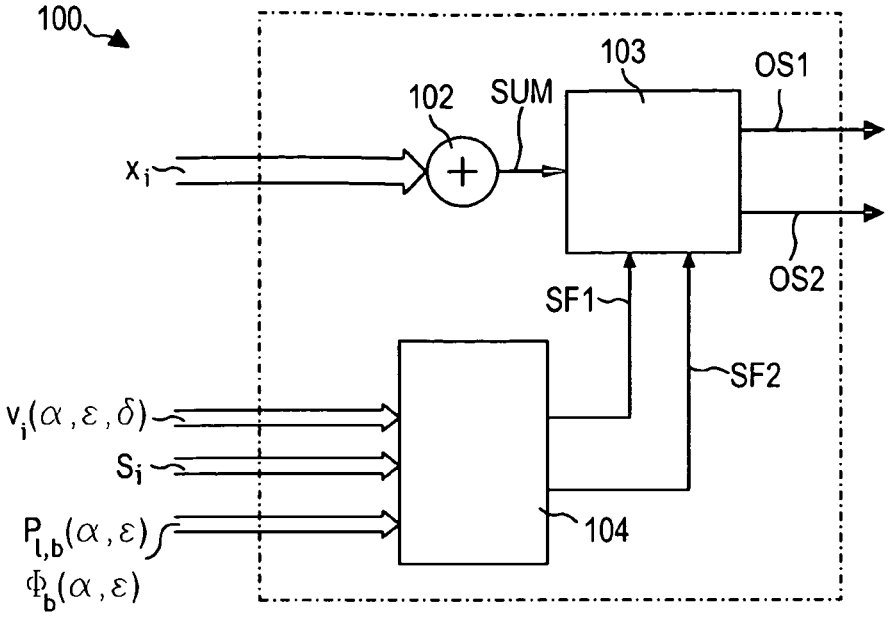
FIG. 1 shows a device for processing audio data in accordance with a preferred embodiment of the invention.

The illustrations in the drawings are schematic. In different drawings, the same reference signs denote similar or identical elements.

A device 100 for processing input audio data $X_i$ in accordance with an embodiment of the invention will now be described with reference to FIG. 1.

The device 100 comprises a summation unit 102 adapted to receive a number of audio input signals $X_i$ for generating a summation signal SUM from the audio input signals $X_i$. The summation signal SUM is supplied to a filter unit 103 adapted to filter said summation signal SUM on the basis of filter coefficients, i.e. in the present case a first filter coefficient SF1 and a second filter coefficient SF2, resulting in a first audio output signal OS1 and a second audio output signal OS2. A detailed description of the filter unit 103 is given below.

Furthermore, as shown in FIG. 1, device 100 comprises a parameter conversion unit 104 adapted to receive, on the one hand, position information $V_i$, which is representative of spatial positions of sound sources of said audio input signals $X_i$, and, on the other hand, spectral power information $S_i$, which is representative of a spectral power of said audio input signals $X_i$, wherein the parameter conversion unit 104 is adapted to generate said filter coefficients SF1, SF2 on the basis of the position information $V_i$ and the spectral power information $S_i$ corresponding to input signal, and wherein the parameter conversion unit 104 is additionally adapted to receive transfer function parameters and generate said filter coefficients additionally in dependence on said transfer function parameters.

Figure 2:
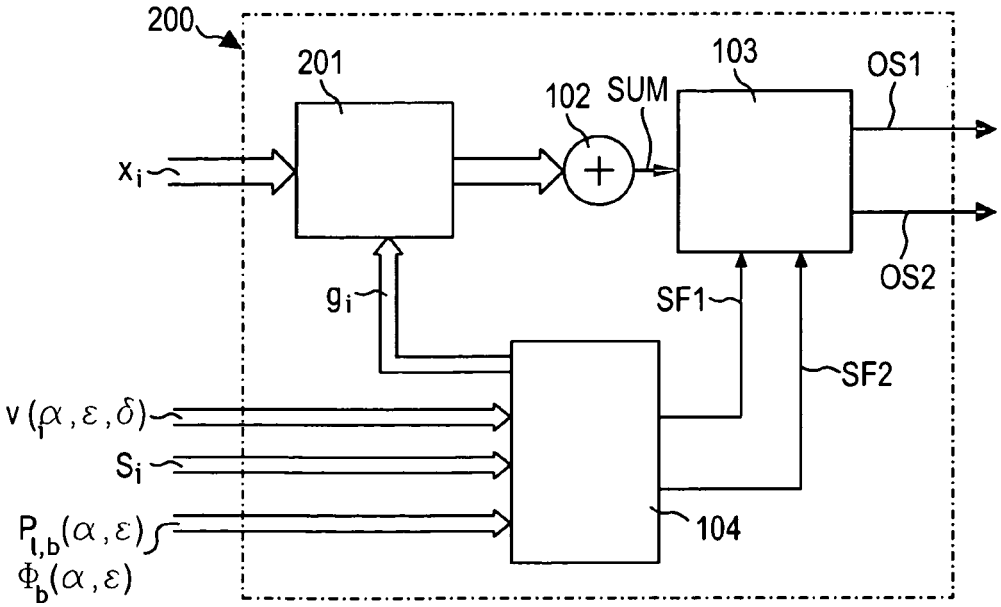
FIG. 2 shows a device for processing audio data in accordance with a further embodiment of the invention.

FIG. 2 shows an arrangement 200 in a further embodiment of the invention. The arrangement 200 comprises a device 100 in accordance with the embodiment shown in FIG. 1 and additionally comprises a scaling unit 201 adapted to scale the audio input signals $X_i$ based on gain factors $g_i$. In this embodiment, the parameter conversion unit 104 is additionally adapted to receive distance information representative of distances of sound sources of the audio input signals and generate the gain factors $g_i$ based on said distance information and provide these gain factors $g_i$ to the scaling unit 201. Hence, an effect of distance is reliably achieved by means of simple measures.

An embodiment of a system or device according to the invention will now be described in more detail with reference to FIG. 3.

Figure 3:
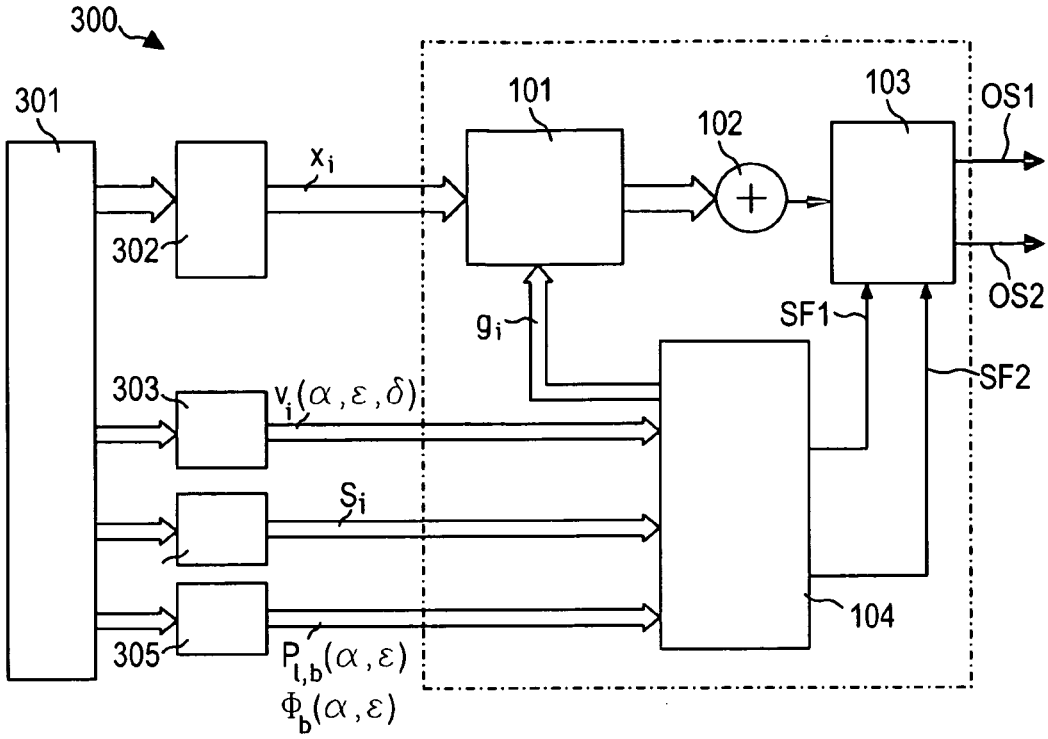
FIG. 3 shows a device for processing audio data in accordance with an embodiment of the invention, comprising a storage unit.

In the embodiment of FIG. 3, a system 300 is shown, which comprises an arrangement 200 in accordance with the embodiment shown in FIG. 2 and additionally comprises a storage unit 301, an audio data interface 302, a position data interface 303, a spectral power data interface 304 and a HRTF parameter interface 305.

The storage unit 301 is adapted to store audio waveform data and the audio data interface 302 is adapted to provide the number of audio input signals $X_i$ based on the stored audio waveform data.

In the present case, the audio waveform data is stored in the form of pulse code-modulated (PCM) wave tables for each sound source. However, waveform data may be stored additionally or separately in another form, for instance, in a compressed format as in accordance with the standards MPEG-1 layer3 (MP3), Advanced Audio Coding (AAC), AAC-Plus, etc.

In the storage unit 301, also position information $V_i$ is stored for each sound source and the position data interface 303 is adapted to provide the stored position information $V_i$.

In the present case, the preferred embodiment is directed to a computer game application. In such a computer game application, the position information $V_i$ varies over time and depends on the programmed absolute position in a space (i.e. virtual spatial position in a scene of the computer game), but it also depends on user action, for example, when a virtual person or user in the game scene rotates or changes his/her virtual position, the sound source position relative to the user changes or should change as well.

In such a computer game, everything is possible from a single sound source (for example, a gunshot from behind) to polyphonic music with every music instrument at a different spatial position in a scene of the computer game. The number of simultaneous sound sources may be, for instance, as high as sixty-four (64) and, accordingly, the audio input signals $X_i$ will range from $X_1$ to $X_{64}$.

The interface unit 302 provides the number of audio input signals $X_i$ based on the stored audio waveform data in frames of size n. In the present case, each audio input signal $X_i$ is provided with a sampling rate of eleven (11) kHz. Other sampling rates are also possible, for example, forty-four (44) kHz for each audio input signal $X_i$.

In the scaling unit 201, the input signals $X_i$ of size n, i.e. $X_i[n]$, are combined into a summation signal SUM, i.e. a mono signal m[n], using gain factors or weights $g_i$ per channel according to equation one (1):

$$m[n] = \sum_i g_i[n]x_i[n] \tag{1}$$

The gain factors $g_i$ are provided by the parameter conversion unit 104 based on stored distance information accompanied by the position information $V_i$ as explained above. The position information $V_i$ and spectral power information $S_i$ parameters typically have much lower update rates, for example, an update every eleventh (11) millisecond. In the present case, the position information $V_i$ per sound source consists of a triplet of azimuth, elevation and distance information. Alternatively, Cartesian coordinates (x,y,z) or alternative coordinates may be used. Optionally, the position information may comprise information in a combination or a subset, i.e. in terms of elevation information and/or azimuth information and/or distance information.

In principle, the gain factors $g_i[n]$ are time-dependent. However, given the fact that the required update rate of these gain factors is significantly lower than the audio sampling rate of the input audio signals $X_i$, it is assumed that the gain factors $g_i[n]$ are constant for a short period of time (as mentioned before, around eleven (11) milliseconds to twenty-three (23) milliseconds). This property allows frame-based processing, in which the gain factors $g_i$ are constant and the summation signal m[n] is represented by equation two (2):

$$m[n] = \sum_i g_i x_i[n] \tag{2}$$

Filter unit 103 will now be explained with reference to FIGS. 4 and 5.

Figure 4:
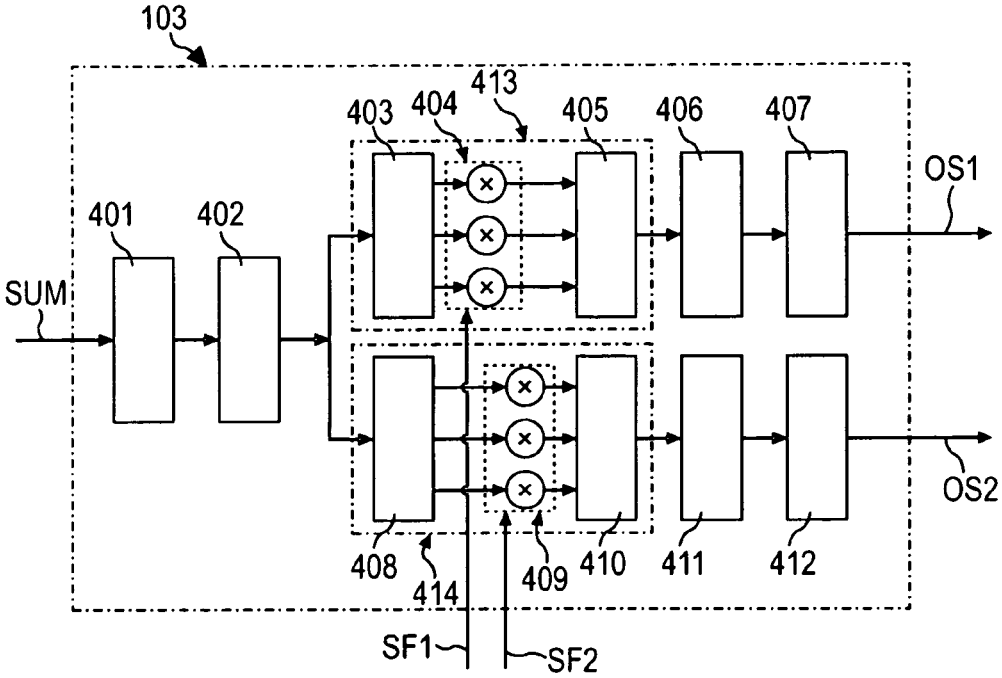
FIG. 4 shows in detail a filter unit implemented in the device for processing audio data shown in FIG. 1 or FIG. 2.

The filter unit 103 shown in FIG. 4 comprises a segmentation unit 401, a Fast Fourier Transform (FFT) unit 402, a first sub-band grouping unit 403, a first mixer 404, a first combination unit 405, a first inverse-FFT unit 406, a first overlap-adding unit 407, a second sub-band grouping unit 408, a second mixer 409, a second combination unit 410, a second inverse-FFT unit 411 and a second overlap-adding unit 412. The first sub-band grouping unit 403, the first mixer 404 and the first combination unit 405 constitute a first mixing unit 413. Likewise, the second sub-band grouping unit 408, the second mixer 409 and the second combination unit 410 constitute a second mixing unit 414.

The segmentation unit 401 is adapted to segment an incoming signal, i.e. the summation signal SUM and signal m[n], respectively, in the present case, into overlapping frames and to window each frame. In the present case, a Hanning window is used for windowing. Other methods may be used, for example, a Welch, or triangular window.

Subsequently, FFT unit 402 is adapted to transform each windowed signal to the frequency domain using an FFT.

In the given example, each frame m[n] of length N (n=0 . . . N−1) is transformed to the frequency domain using an FFT:

$$M[k] = \sum_i m[n]\exp(-2\pi jkn/N) \tag{3}$$

This frequency-domain representation M[k] is copied to a first channel, further also referred to as left channel L, and to a second channel, further also referred to as right channel P Subsequently, the frequency-domain signal M[k] is split into sub-bands b (b=0 . . . B−1) by grouping FFT bins for each channel, i.e. the grouping is performed by means of the first sub-band grouping unit 403 for the left channel L and by means of the second sub-band grouping unit 408 for the right channel R. Left output frames L[k] and right output frames R[k] (in the FFT domain) are then generated on a band-by-band basis.

The actual processing consists of modification (scaling) of each FFT bin in accordance with a respective scale factor that was stored for the frequency range to which the current FFT bin corresponds, as well as modification of the phase in accordance with the stored time or phase difference. With respect to the phase difference, the difference can be applied in an arbitrary way (for example, to both channels (divided by two) or only to one channel). The respective scale factor of each FFF bin is provided by means of a filter coefficient vector, i.e. in the present case the first filter coefficient SF1 provided to the first mixer 404 and the second filter coefficient SF2 provided to the second mixer 409.

In the present case, the filter coefficient vector provides complex-valued scale factors for frequency sub-bands for each output signal.

Then, after scaling, the modified left output frames L[k] are transformed to the time domain by the inverse FFT unit 406 obtaining a left time-domain signal, and the right output frames R[k] are transformed by the inverse FFT unit 411 obtaining a right time-domain signal. Finally, an overlap-add operation on the obtained time-domain signals results in the final time domain for each output channel, i.e. by means of the first overlap-adding unit 407 obtaining the first output channel signal OS1 and by means of the second overlap-adding unit 412 obtaining the second output channel signal OS2.

Figure 5:
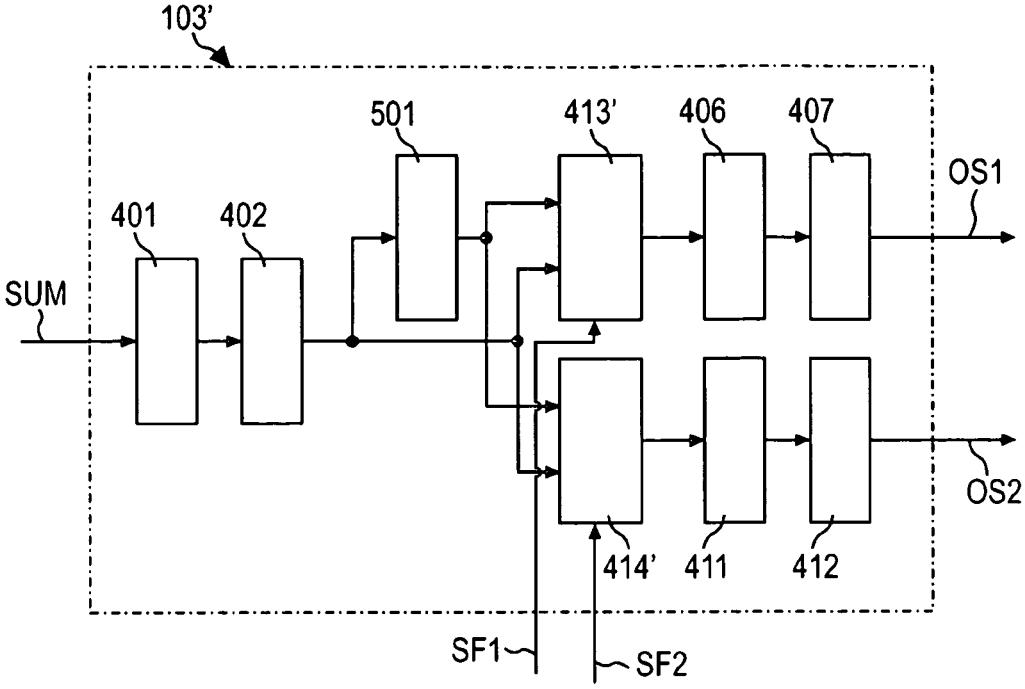
FIG. 5 shows a further filter unit in accordance with an embodiment of the invention.

The filter unit 103' shown in FIG. 5 deviates from the filter unit 103 shown in FIG. 4 in that a decorrelation unit 501 is provided, which is adapted to supply a decorrelation signal to each output channel, which decorrelation signal is derived from the frequency-domain signal obtained from the FFT unit 402. In the filter unit 103' shown in FIG. 5, a first mixing unit 413' similar to the first mixing unit 413 shown in FIG. 4 is provided, but it is additionally adapted to process the decorrelation signal. Likewise, a second mixing unit 414' similar to the second mixing unit 414 shown in FIG. 4 is provided, which second mixing unit 414' of FIG. 5 is also additionally adapted to process the decorrelation signal.

In this case, the two output signals L[k] and R[k] (in the FFT domain) are then generated as follows on a band-by-band basis:

$$\begin{cases} L_b[k] = h_{11,b}M_b[k] + h_{12,b}D_b[k] \\ R_b[k] = h_{21,b}M_b[k] + h_{22,b}D_b[k] \end{cases} \tag{4}$$

Here, D[k] denotes the decorrelation signal that is obtained from the frequency-domain representation M[k] according to the following properties:

$$\forall (b)\begin{cases} \langle D_b, M_b^* \rangle = 0 \\ \langle D_b, D_b^* \rangle = \langle M_b, M_b^* \rangle \end{cases} \tag{5}$$

wherein <.> denotes the expected value operator:

$$\langle X_b, Y_b^* \rangle = \sum_{k=k_b}^{k=k_{b-1}-1} X[k]Y^*[k] \tag{6}$$

Here, (*) denotes complex conjugation.

The decorrelation unit 501 consists of a simple delay with a delay time of the order of 10 to 20 ms (typically one frame) that is achieved, using a FIFO buffer. In further embodiments, the decorrelation unit may be based on a randomized magnitude or phase response, or may consist of IIR or all-pass-like structures in the FFT, sub-band or time domain. Examples of such decorrelation methods are given in Engdegård, Heiko Purnhagen, Jonas Rödén, Lars Liljeryd (2004): "Synthetic ambiance in parametric stereo coding", proc. 116th AES convention, Berlin, the disclosure of which is herewith incorporated by reference.

The decorrelation filter aims at creating a "diffuse" perception at certain frequency bands. If the output signals arriving at the two ears of a human listener are identical, except for a time or level difference, the human listener will perceive the sound as coming from a certain direction (which depends on the time and level difference). In this case, the direction is very clear, i.e. the signal is spatially "compact".

However, if multiple sound sources arrive at the same time from different directions, each ear will receive a different mixture of sound sources. Therefore, the differences between the ears cannot be modeled as a simple (frequency-dependent) time and/or level difference. Since, in the present case, the different sound sources are already mixed into a single sound source, recreation of different mixtures is not possible. However, such a recreation is basically not required because the human hearing system is known to have difficulty in separating individual sound sources based on spatial properties. The dominant perceptual aspect in this case is how different the waveforms at both ears are if the waveforms for time and level differences are compensated. It has been shown that the mathematical concept of the inter-channel coherence (or maximum of the normalized cross-correlation function) is a measure that closely matches the perception of spatial 'compactness'.

The main aspect is that the correct inter-channel coherence has to be recreated in order to evoke a similar perception of the virtual sound sources, even if the mixtures at both ears are wrong. This perception can be described as "spatial diffuseness", or lack of "compactness". This is what the decorrelation filter, in combination with the mixing unit, recreates.

The parameter conversion unit 104 determines how different the waveforms would have been in the case of a regular HRTF system if these waveforms had been based on single sound source processing. Then, by mixing the direct and decorrelated signal differently in the two output signals, it is possible to recreate this difference in the signals that cannot be attributed to simple scaling and time delays. Advantageously, a realistic sound stage is obtained by recreating such a diffuseness parameter.

As already mentioned, the parameter conversion unit 104 is adapted to generate filter coefficients SF1, SF2 from the position vectors $V_i$ and the spectral power information $S_i$ for each audio input signal $X_i$. In the present case, the filter coefficients are represented by complex-valued mixing factors $h_{xx,b}$. Such complex-valued mixing factors are advantageous, especially in a low-frequency area. It may be mentioned that real-valued mixing factors may be used, especially when processing high frequencies.

The values of the complex-valued mixing factors $h_{xx,b}$ depend in the present case on, inter alia, transfer function parameters representing Head-Related Transfer Function (HRTF) model parameters $P_{1,b}(\alpha,\epsilon)$, $P_{r,b}(\alpha,\epsilon)$ and $\phi_b(\alpha,\epsilon)$: Herein, the HRTF model parameter $P_{1,b}(\alpha,\epsilon)$ represents the root-mean-square (rms) power in each sub-band b for the left ear, the HRTF model parameter $P_{r,b}(\alpha,\epsilon)$ represents the rms power in each sub-band b for the right ear, and the HRTF model parameter $\phi_b(\alpha,\epsilon)$ represents the average complex-valued phase angle between the left-ear and right-ear HRTF. All HRTF model parameters are provided as a function of azimuth ($\alpha$) and elevation ($\epsilon$). Hence, only HRTF parameters $P_{1,b}(\alpha,\epsilon)$, $P_{r,b}(\alpha,\epsilon)$ and $\phi_b(\alpha,\epsilon)$ are required in this application, without the necessity of actual HRTFs (that are stored as finite impulse-response tables, indexed by a large number of different azimuth and elevation values).

The HRTF model parameters are stored for a limited set of virtual sound source positions, in the present case for a spatial resolution of twenty (20) degrees in both the horizontal and vertical direction. Other resolutions may be possible or suitable, for example, spatial resolutions of ten (10) or thirty (30) degrees.

In an embodiment, an interpolation unit may be provided, which is adapted to interpolate HRTF model parameters in between the spatial resolution, which are stored. A bi-linear interpolation is preferably applied, but other (non-linear) interpolation schemes may be suitable.

By providing HRTF model parameters according to the present invention over conventional HRTF tables, an advantageous faster processing can be performed. Particularly in computer game applications, if head motion is taken into account, playback of the audio sound sources requires rapid interpolation between the stored HRTF data.

In a further embodiment, the transfer function parameters provided to the parameter conversion unit may be based on, and represent, a spherical head model.

In the present case, the spectral power information $S_i$ represents a power value in the linear domain per frequency sub-band corresponding to the current frame of input signal $X_i$. One could thus interpret $S_i$ as a vector with power or energy values $\sigma^2$ per sub-band:

$$S_i=[(\sigma^2_{0,i},\sigma^2_{1,i},\ldots,\sigma^2_{b,i}]$$

The number of frequency sub-bands (b) in the present case is ten (10). It should be mentioned here that spectral power information $S_i$ may be represented by power value in the power or logarithmic domain, and the number of frequency sub-bands may achieve a value of thirty (30) or forty (40) frequency sub-bands.

The power information $S_i$ basically describes how much energy a certain sound source has in a certain frequency band and sub-band, respectively. If a certain sound source is dominant (in terms of energy) in a certain frequency band over all other sound sources, the spatial parameters of this dominant sound source get more weight on the 'composite' spatial parameters that are applied by the filter operations. In other words, the spatial parameters of each sound source are weighted by using the energy of each sound source in a frequency band to compute an averaged set of spatial parameters. An important extension to these parameters is that not only a phase difference and level per channel is generated, but also a coherence value. This value describes how similar the waveforms should be that are generated by the two filter operations.

In order to explain the criteria for the filter factors or complex-valued mixing factors $h_{xx,b}$, an alternative pair of output signals, viz. L' and R', is introduced, which output signals L', R' would result from independent modification of each input signal $X_i$ in accordance with HRTF parameters $P_{1,b}(\alpha,\epsilon)$, $P_{r,b}(\alpha,\epsilon)$ and $\phi_b(\alpha,\epsilon)$, followed by summation of the outputs:

$$\begin{cases} L'[k] = \sum_i X_i[k]\,p_{l,b,i}(\alpha_i,\varepsilon_i)\dfrac{\exp(+j\phi_{b,i}(\alpha_i,\varepsilon_i)/2)}{\delta_i} \\ R'[k] = \sum_i X_i[k]\,p_{r,b,i}(\alpha_i,\varepsilon_i)\dfrac{\exp(-j\phi_{b,i}(\alpha_i,\varepsilon_i)/2)}{\delta_i} \end{cases} \tag{7}$$

The mixing factors $h_{xx,b}$ are then obtained in accordance with the following criteria:

1. The input signals $X_i$ are assumed to be mutually independent in each frequency band b:

$$\forall\,(b)\begin{cases} \langle X_{b,i}, X^*_{b,j}\rangle = 0 \text{ for } i \neq j \\ \langle X_{b,i}, X^*_{b,i}\rangle = \sigma^2_{b,i} \end{cases} \tag{8}$$

2. The power of the output signal L[k] in each sub-band b should be equal to the power in the same sub-band of a signal L'[k]:

$$\forall\,(b)(\langle L_b, L^*_b\rangle = \langle L'_b, L'^*_b\rangle) \tag{9}$$

3. The power of the output signal R[k] in each sub-band b should be equal to the power in the same sub-band of a signal R'[k]:

$$\forall\,(b)(\langle R_b, R^*_b\rangle = \langle R'_b, R'^*_b\rangle) \tag{10}$$

4. The average complex angle between signals L[k] and M[k] should equal the average complex phase angle between signals L'[k] and M[k] for each frequency band b:

$$\forall\,(b)(\angle\langle L_b, M^*_b\rangle = \angle\langle L'_b, M^*_b\rangle) \tag{11}$$

5. The average complex angle between signals R[k] and M[k] should equal the average complex phase angle between signals R'[k] and M[k] for each frequency band b:

$$\forall\,(b)(\angle\langle R_b, M^*_b\rangle = \angle\langle R'_b, M^*_b\rangle) \tag{12}$$

6. The coherence between signals L[k] and R[k] should be equal to the coherence between signals L'[k] and R'[k] for each frequency band b:

$$\forall\,(b)(|\langle L_b, R^*_b\rangle| = |\langle L'_b, R'^*_b\rangle|) \tag{13}$$

It can be shown that the following (non-unique) solution fulfils the criteria above:

$$\begin{cases} h_{11,b} = H_{1,b}\cos(+\beta_b+\gamma_b) \\ h_{11,b} = H_{1,b}\sin(+\beta_b+\gamma_b) \\ h_{11,b} = H_{2,b}\cos(-\beta_b+\gamma_b) \\ h_{11,b} = H_{2,b}\cos(-\beta_b+\gamma_b) \end{cases} \tag{14}$$

with

-continued $$\beta_b = \frac{1}{2}\arccos\left(\frac{|\langle L'_b, R'^*_b\rangle|}{\sqrt{\langle L'_b, L'^*_b\rangle\langle R'_b, R'^*_b\rangle}}\right) \tag{15}$$

$$= \frac{1}{2}\arccos\left(\frac{\sum_i P_{l,b,i}(\alpha_i, \varepsilon_i)P_{r,b,i}(\alpha_i, \varepsilon_i)\sigma^2_{b,l}/\delta^2_i}{\sqrt{\sum_i P^2_{l,b,i}(\alpha_i, \varepsilon_i)\sigma^2_{b,i}/\delta^2_i \sum_i P^2_{r,b,i}(\alpha_i, \varepsilon_i)\sigma^2_{b,i}/\delta^2_i}}\right)$$

$$\gamma_b = \arctan\left(\tan(\beta_b)\frac{|H_{2,b}| - |H_{1,b}|}{|H_{2,b}| + |H_{1,b}|}\right) \tag{16}$$

$$H_{1,b} = \exp(j\varphi_{i,b})\sqrt{\frac{\sum_i p^2_{l,b,i}(\alpha_i, \varepsilon_i)\sigma^2_{b,i}/\delta^2_i}{\sum_i \sigma^2_{b,i}/\delta^2_i}} \tag{17}$$

$$H_{2,b} = \exp(j\varphi_{R,b})\sqrt{\frac{\sum_i P^2_{r,b,i}(\alpha_i, \varepsilon_i)\sigma^2_{b,i}/\delta^2_i}{\sum_i \sigma^2_{b,i}/\delta^2_i}} \tag{18}$$

$$\varphi_{L,b} = \angle\left(\sum_i \exp(+j\phi_{b,i}(\alpha_i, \varepsilon_i)/2)p_{l,b,i}(\alpha_i, \varepsilon_i)\sigma^2_{b,i}/\delta^2_i\right) \tag{19}$$

$$\varphi_{R,b} = \angle\left(\sum_i \exp(-j\phi_{b,i}(\alpha_i, \varepsilon_i)/2)p_{r,b,i}(\alpha_i, \varepsilon_i)\sigma^2_{b,i}/\delta^2_i\right) \tag{20}$$

Herein, $\sigma_{b,i}$ denotes the energy or power in sub-band b of signal $X_i$, and $\delta_i$ represents the distance of sound source i.

In a further embodiment of the invention, the filter unit 103 is alternatively based on a real-valued or complex-valued filter bank, i.e. IIR filters or FIR filters that mimic the frequency dependency of $h_{xy,b}$, so that an FFT approach is not required anymore.

In an auditory display, the audio output is conveyed to the listener either through loudspeakers or through headphones worn by the listener. Both headphones and loudspeakers have their advantages as well as shortcomings, and one or the other may produce more favorable results depending on the application. With respect to a further embodiment, more output channels may be provided, for example, for headphones using more than one speaker per ear, or a loudspeaker playback configuration.

It should be noted that use of the verb "comprise" and its conjugations does not exclude other elements or steps, and use of the article "a" or "an" does not exclude a plurality of elements or steps. Also elements described in association with different embodiments may be combined.

It should also be noted that reference signs in the claims shall not be construed as limiting the scope of the claims.

The invention claimed is:

1. A device for processing audio data comprising:

a summation unit configured to receive a number of audio input signals for generating a summation signal;

a filter unit configured to filter said summation signal dependent on filter coefficients resulting in at least two audio output signals, and a parameter conversion unit configured to receive position information, which is representative of spatial positions of sound sources of said audio input signals, and spectral power information which is representative of a spectral power of said audio input signals, wherein the parameter conversion unit is configured to generate said filter coefficients on the basis of the position information and the spectral power information; and a scaling unit configured to scale the audio input signals based on gain factors generated by the parameter conversion unit;

wherein the parameter conversion unit is further configured to receive transfer function parameters and generate said filter coefficients in dependence on said transfer function parameters;

and the device being characterized by the parameter conversion unit being arranged to generate the filter coefficients in response to an averaged set of spatial parameters determined by a weighting of spatial parameters of each sound source depending on an energy of each sound source in a frequency band.

2. The device as claimed in claim 1, wherein the transfer function parameters are parameters representing Head-Related Transfer Functions (HRTFs) for each audio output signal, said transfer function parameters representing a power in frequency sub-bands and a real-valued phase angle or complex-valued phase angle per frequency sub-band between the Head-Related Transfer Functions of each output channel as a function of azimuth and elevation.

3. The device as claimed in claim 2, wherein the complex-valued phase angle per frequency sub-band represents an average phase angle between the Head-Related Transfer Functions of each output channel.

4. The device as claimed in claim 1, wherein the parameter conversion unit is further configured to receive distance information, which is representative of distances of the sound sources of the audio input signals, and to generate the gain factors based on said distance information.

5. The device as claimed in claim 1, wherein the filter unit is based on a Fast Fourier Transform (FFT) or a real-valued or complex-valued filter bank.

6. The device as claimed in claim 5, wherein the filter unit further comprises a decorrelation unit configured to apply a decorrelation signal to each of the at least two audio output signals.

7. The device as claimed in claim 5, wherein the filter unit is further configured to process the filter coefficients that are provided in a form of complex-valued scale factors for frequency sub-bands for each output signal.

8. The device as claimed in claim 1, further comprising a memory configured to store audio waveform data, and an interface unit for providing the number of audio input signals based on the stored audio waveform data.

9. The device as claimed in claim 8, wherein the memory is configured to store the audio waveform data in a pulse code-modulated format and/or in a compressed format.

10. The device as claimed in claim 8, wherein the memory is further configured to store the spectral power information per time and/or frequency sub-band.

11. The device as claimed in claim 1, wherein the position information comprises information in terms of elevation information and/or azimuth information and/or distance information.

12. The device as claimed in claim 8, realized as one of the group consisting of a portable audio player, a portable video player, a head-mounted display, a mobile phone, a DVD player, a CD player, a hard disk-based media player, an internet radio device, a public entertainment device, an MP3 player, a PC-based media player, a telephone conference device, and a jet fighter.

13. A method of processing audio data, wherein the method comprises the acts of:

receiving a number of audio input signals for generating a summation signal;

filtering said summation signal by a filter having filter coefficients resulting in at least two audio output signals;

receiving position information, which is representative of spatial positions of sound sources of said audio input signals, and spectral power information which is representative of a spectral power of said audio input signals, generating said filter coefficients by a parameter conversion unit based on the position information and the spectral power information; and receiving transfer function parameters and generating said filter coefficients in dependence on said transfer function parameters; and scaling the audio input signals based on gain factors generated by the parameter conversion unit;

wherein the filter coefficients are generated in response to an averaged set of spatial parameters determined by a weighting of spatial parameters of each sound source depending on an energy of each sound source in a frequency band.

14. A non-transitory computer-readable medium, in which a computer program for processing audio data is stored, wherein the computer program, when executed by a processor, configure the processor to perform the acts of:

receiving a number of audio input signals for generating a summation signal;

filtering said summation signal dependent on filter coefficients resulting in at least two audio output signals;

receiving, on the one hand, position information, which is representative of spatial positions of sound sources of said audio input signals, and, on the other hand, spectral power information which is representative of a spectral power of said audio input signals, generating said filter coefficients by a parameter conversion unit based on the position information and the spectral power information; and receiving transfer function parameters and generating said filter coefficients in dependence on said transfer function parameters; and scaling the audio input signals based on gain factors generated by the parameter conversion unit;

wherein the filter coefficients are generated in response to an averaged set of spatial parameters determined by a weighting of spatial parameters of each sound source depending on an energy of each sound source in a frequency band.

* * * * *